US005899564A

United States Patent [19]

Kinney et al.

[11] Patent Number: 5,899,564

[45] Date of Patent: May 4, 1999

[54] HOMOGENIZATION VALVE

[75] Inventors: Richard R. Kinney, Boxford; William D. Pandolfe, Billerica; R. Daniel Ferguson, Melrose, all of Mass.

[73] Assignee: APV Homogenizer Group, Div. of APV North America, Wilmington, Mass.

[21] Appl. No.: 09/076,297

[22] Filed: May 11, 1998

Related U.S. Application Data

[63] Continuation of application No. 08/816,278, Mar. 13, 1997, Pat. No. 5,749,650.

[51] Int. Cl.[6] ..... B01F 5/00

[52] U.S. Cl. ..... 366/176.2; 366/336; 138/43

[58] Field of Search ..... 137/625.33; 366/176.1, 366/176.2, 336, 337, 340; 138/43.45; 239/434, 554, 555

[56] References Cited

U.S. PATENT DOCUMENTS

| | | | |
|---|---|---|---|
| 366,169 | 7/1887 | Hyatt . | |
| 973,328 | 10/1910 | Willmann . | |
| 996,704 | 7/1911 | Cribbins . | |
| 1,070,218 | 8/1913 | Willmann . | |
| 1,070,226 | 8/1913 | Becker . | |
| 1,112,594 | 10/1914 | Brawner, Jr. . | |
| 1,266,501 | 5/1918 | Leitch . | |
| 1,436,947 | 11/1922 | Davis . | |
| 1,533,843 | 4/1925 | Ferns . | |
| 2,882,025 | 4/1959 | Loo | 259/4 |
| 3,179,385 | 4/1965 | Deackoff | 259/98 |
| 3,526,391 | 9/1970 | Church, Jr. | 259/4 |
| 3,732,851 | 5/1973 | Self | 122/487 |
| 4,081,863 | 3/1978 | Rees | 366/176 |
| 4,160,002 | 7/1979 | Janovtchik | 261/76 |
| 4,205,696 | 6/1980 | Gongwer | 137/1 |
| 4,352,573 | 10/1982 | Pandolfe | 366/176 |
| 4,383,769 | 5/1983 | Pandolfe | 366/337 |
| 4,533,254 | 8/1985 | Cook et al. | 366/176 |
| 4,585,357 | 4/1986 | Ogata | 366/176 |
| 4,921,014 | 5/1990 | Tartaglia et al. | 138/43 X |
| 4,952,067 | 8/1990 | Dallas | 366/337 |
| 5,575,561 | 11/1996 | Rohwer | 366/336 |

FOREIGN PATENT DOCUMENTS

| | | | |
|---|---|---|---|
| 23 60 392 | 1/1975 | Germany | F16K 47/02 |
| 2 039 225 | 8/1980 | United Kingdom | B01F 5/08 |

OTHER PUBLICATIONS

Pandolfe, W.D., "Cell Disruption by Homogenization," *APV Homogenizers, Gaulin, Rannie,* pp. 1–20 (1993).

Tennekes, H., et al., "A First Course in Turbulence," *The MIT Press, Library of Congress Catalog Card Number: 77–165072*, pp. 129–131 (1972).

Perry, R.H., et al., "Chemical Engineers' Handbook, "Fifth Edition, *McGraw–Hill Book Company,*pp. 5–20 (1973).

Stevenson, M., "Visualization of the Flow Patterns in a High–Pressure Homogenizing Valve Using a CFD Package," *Journal of Food Engineering*, Vol. 33:151–165 (1997).

*Primary Examiner*—John Fox

*Attorney, Agent, or Firm*—Hamilton, Brook, Smith & Reynolds, P.C.

[57] ABSTRACT

An homogenization valve design yields improved homogenization efficiency. The length of the valve surface relative to the valve seat or land is controlled so that the overlap is limited. This allows convergence between turbulent mixing layers and a homogenization zone. Preferably some overlap is provided, however, to contribute to the stability of the valves and avoid destructive chattering.

7 Claims, 6 Drawing Sheets

HOMOGENIZATION VALVE

RELATED APPLICATION(S)

This application is a continuation of U.S. application No. 08/816,278, filed on Mar. 13, 1997, now U.S. Pat. No. 5,749,650 the entire teachings of which are incorporated herein by reference.

BACKGROUND OF THE INVENTION

Homogenization is the process of breaking down and blending components within a fluid. One familiar example is milk homogenization in which milk fat globules are broken-up and distributed into the bulk of the milk. Homogenization is also used to process other emulsions such as silicone oil and process dispersions such as pigments, antacids, and some paper coatings.

The most common device for performing homogenization is a homogenization valve. The emulsion or dispersion is introduced under high pressure into the valve, which functions as a flow restrictor to generate intense turbulence. The high pressure fluid is forced out through a usually narrow valve gap into a lower pressure environment.

Homogenization occurs in the region surrounding the valve gap. The fluid undergoes rapid acceleration coupled with extreme drops in pressure. Theories have suggested that both turbulence and cavitation in this region are the mechanisms that facilitate the homogenization.

Early homogenization valves had a single valve plate that was thrust against a valve seat by some, typically mechanical or hydraulic, actuating system. Milk, for example, was expressed through an annular aperture or valve slit between the valve and the valve seat.

While offering the advantage of a relatively simple construction, the early valves could not efficiently handle high milk flow rates. Homogenization occurs most efficiently with comparatively small valve gaps, which limits the milk flow rate for a given pressure. Thus, higher flow rates could only be achieved by increasing the diameter or size of a single homogenizing valve.

Newer homogenization valve designs have been more successful at accommodating high flow rates while maintaining optimal valve gaps. Some of the best examples of these designs are disclosed in U.S. Pat. Nos. 4,352,573 and 4,383,769 to William D. Pandolfe and assigned to the instant assignee, the teachings of these patents being incorporated herein in their entirety by this reference. Multiple, annular, valve members are stacked one on top of the other. The central holes of the stacked members define a common, typically high pressure, chamber. Annular grooves are formed on the top and/or bottom surfaces of each valve member, concentric with the central hole. The grooves are in fluid communication with each other via axially directed circular ports that extend through the members, and together the grooves and ports define a second, typically low pressure, chamber. In each valve member, the wall between the central hole and the grooves is chamfered to provide knife edges. Each knife edge forms a valve seat spaced a small distance from an opposed valve surface on the adjacent valve member. In this design, an optimal valve spacing can be maintained for any flow rate; higher flow rates are accommodated simply by adding more valve members to the stack.

SUMMARY OF THE INVENTION

Continuing advancements in homogenization valve design are generally driven by two concerns. On one hand, there is a desire for consistently well homogenized products. Milk shelf life is limited by the time between homogenization and when creaming begins to affect visual appearance. This is the reverse of the homogenization process in which the milk fat again becomes separated from the bulk milk. The second, sometimes conflicting, concern is the cost of homogenization, which is largely dictated by the consumed energy.

The size of the milk fat globules in the homogenized milk determines the speed at which creaming occurs. Thus, in order to extend shelf life, it is important that the homogenization process yields small fat globules in the homogenized milk. The smaller the fat globules, the more dispersed is the fat, and the longer it takes for enough of the fat globules to coalesce and produce noticeable creaming. More complete homogenization, however, generally requires higher pressures, which undermines the second concern since higher pressures require larger energy inputs.

The standard deviation in the size of the fat globules in the homogenized milk, however, also plays a role in determining the milk's shelf life. Some valve designs produce generally small fat globules, which suggests a long shelf life. Because of the characteristics of the regions surrounding the valve gap, however, some fat globules can largely or entirely escape the homogenization process as they pass through the valve. These larger fat globules in the homogenized milk contain a relatively large amount of fat, and they cream rapidly compared to very small fat globules. Thus, even though the average size of the fat globules may be small in a given sample of milk, the shelf life may still be relatively short due to the existence of a relatively few large globules.

The present invention is directed to an improved valve member design that is applicable to the design disclosed in the Pandolfe series of patents. More generally, the principals of the present invention may be applied to other homogenization valve configurations.

In general according to one aspect, the invention concerns a homogenizer valve in which flow restricting surfaces oppose each other on either side of a laterally extended valve gap. The downstream terminations of the opposed surfaces are staggered with respect to each other by at least a distance necessary to inhibit chattering of the valve. Research has demonstrated that valves with no overlap tend to be unstable, resulting in shortened operational life-times. The overlap is small enough, however, to ensure that a homogenization zone converges with, or extends across the entire width of, the mixing layers. This results in complete homogenization since portions of the fluid are not able to bypass the zone.

Theory suggests that the downstream terminations of the opposed surfaces in the preferred embodiment should be staggered by at least a height of the valve gap for stability, but staggered not more than approximately ten of the gap heights for complete homogenization. Experimentation with milk homogenization using gaps of less than 0.003 inches, in practice between 0.0010 and 0.0020 inches, indicates that the staggering or overlap should be greater than approximately 0.0010 inches but always less than 0.025 inches.

The preferred homogenizer valve comprises a stack of annularly-shaped valve members defining a central hole and axial fluid conduits. This configuration is applicable in commercial applications requiring flow rates of 500 gal/min and greater. Annular springs are used to align adjoining pairs of the valve members, the springs fitting in spring-grooves formed in the valve members. Homogenization occurs as the fluid passes between the central hole and the axial fluid conduits through the intervening annular valve gaps. Preferably, one of the opposed surfaces in each adjoining pair of the valve members is a knife edge land, which has a total length of preferably between 0.015 to 0.020 inches, but always less than 0.06 inches.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
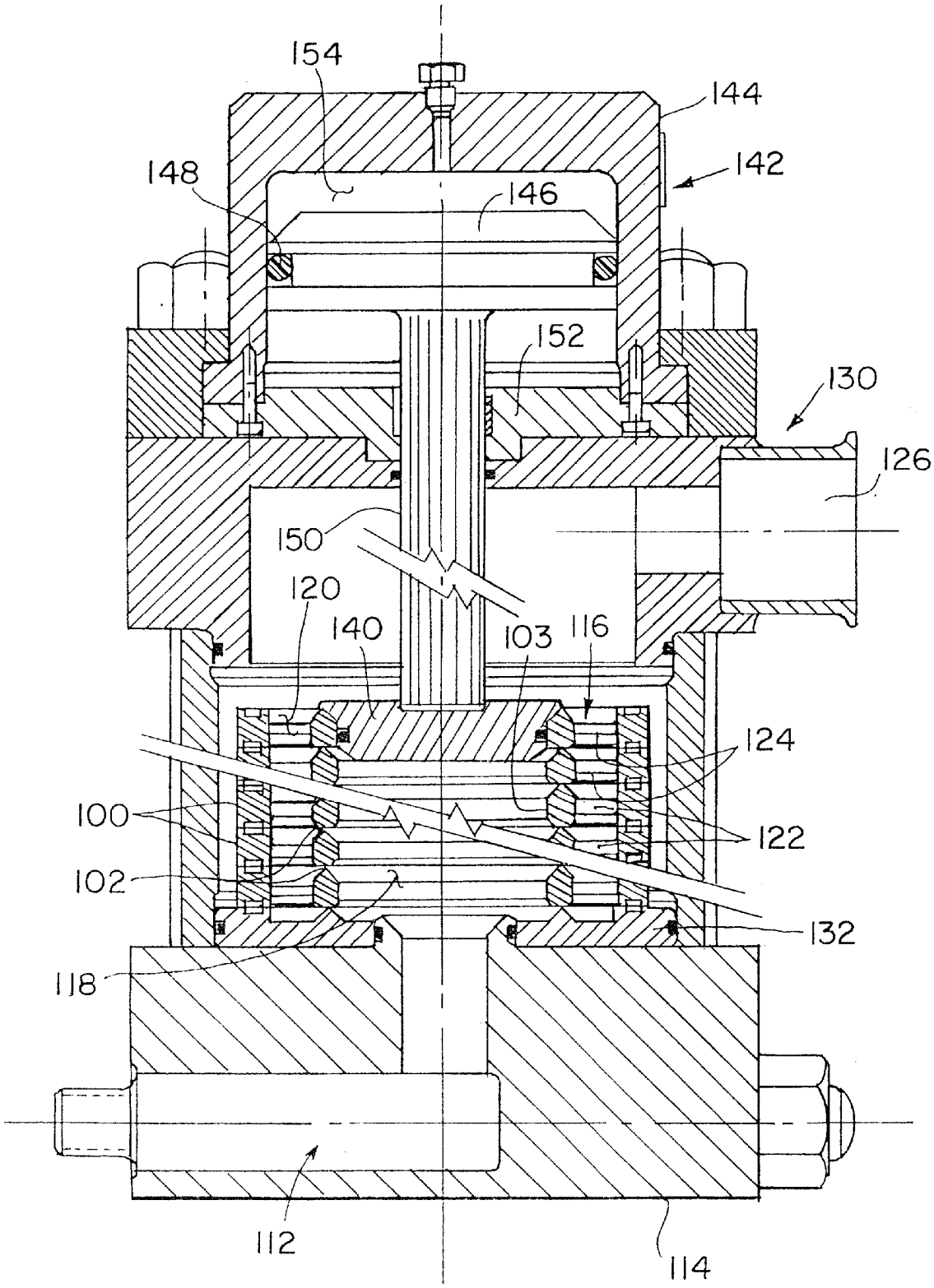
FIG. 1 is a cross sectional view of a homogenization system showing valve members according to the present invention.

FIG. 1 is a cross-sectional view of a homogenization system that is related to the design disclosed in the Pandolfe patents. The system includes valve members 100 constructed according to the principles of the present invention, many of the details of these members being better understood with reference to FIG. 2.

Figure 2:
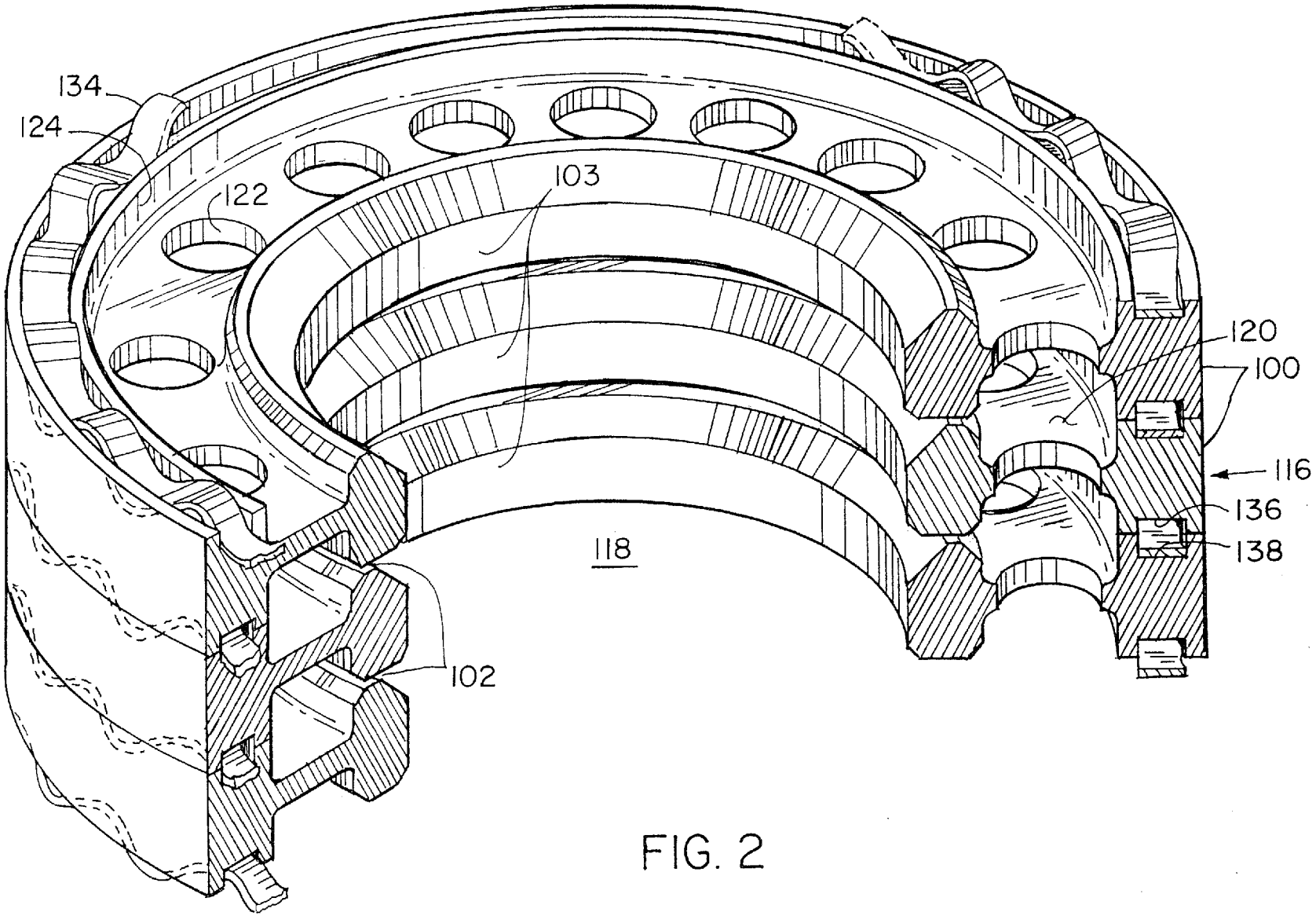
FIG. 2 is a perspective and partially cut-away view of the inventive valve members in a valve member stack in the homogenization system.

With reference to both FIGS. 1 and 2, an inlet port 112, formed in an inlet flange 114, conveys a high pressure fluid to a valve member stack 116. The high pressure fluid is introduced into an inner chamber 118 defined by the central holes 103 formed through the generally annular valve members 100. The high pressure fluid is then expressed through valve gaps 102 into a low pressure chamber 120 that is defined by the axial ports 122 through the valve members 100 and the annular grooves 124 in the valve members. The fluid passing into the low pressure chamber enters a discharge port 126 in a discharge flange assembly 130.

The stack 116 of valve members 100 is sealed against the inlet flange 114 via a base valve member 132. The top-most valve member engages a top valve plug 140 that seals across the inner chamber 118. This top valve plug 140 is hydraulically or pneumatically urged by actuator assembly 142, which comprises an actuator body 144 surrounding an actuator piston 146 sealed to it via an O ring 148. The piston 146 is connected to the top plug 140 via the actuator rod 150. An actuator guide plate 152 sits between the body 144 and the discharge flange assembly 130. By varying the pressure of a hydraulic fluid or pneumatically in cavity 154, the size of the valve gaps 102 may be modulated by inducing the radial flexing of the valve members 100.

The base valve member 132 and other valve members 100 are aligned with respect to each other and maintained in the stack formation by serpentine valve springs 134 that are confined within cooperating spring-grooves 136, 138 formed in the otherwise flat peripheral rim surfaces of each valve member 100.

Figure 3:
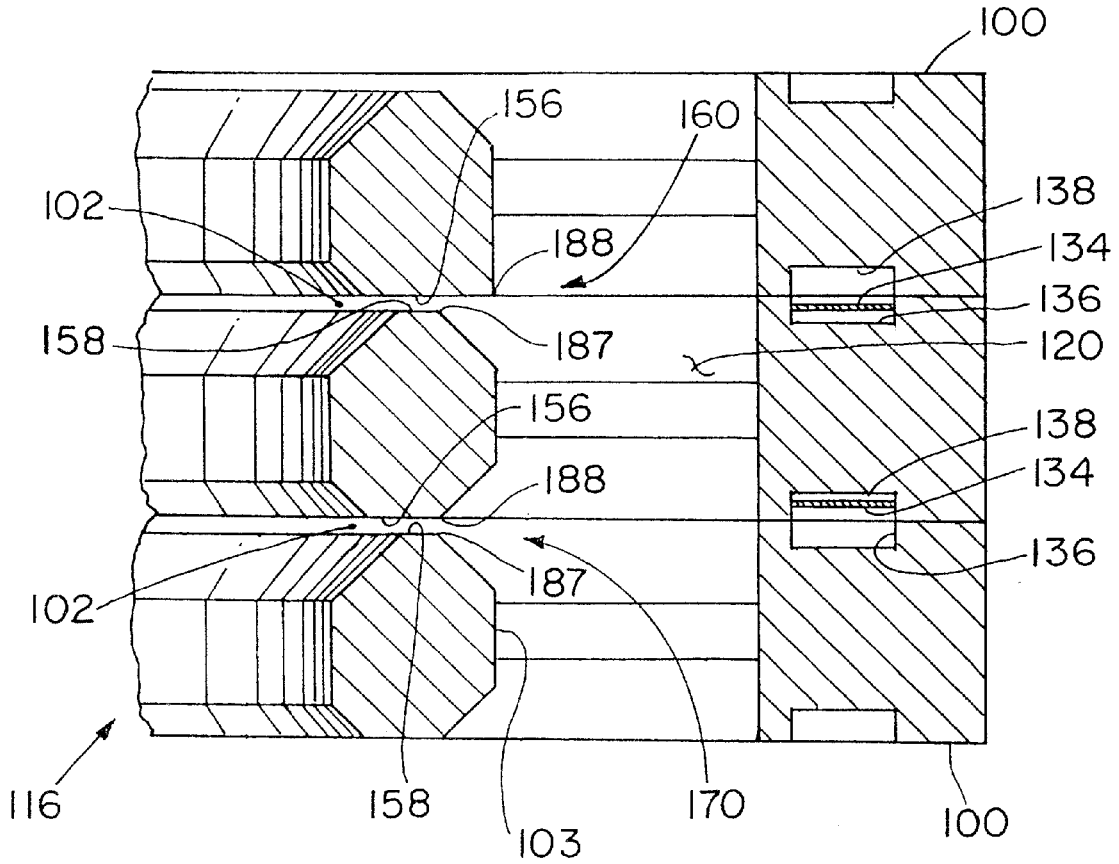
FIG. 3 is a partial vertical cross-sectional view of the stacked valve members showing the valve gap region for a prior art homogenization valve and the inventive homogenization valve.

FIG. 3 is a cross-sectional view of the valve members around the valve gaps, showing a prior art valve gap region 160 and the valve gap region 170 in the inventive homogenization valve.

The height of both gaps is preferably between 0.0015 and 0.0020 inches, usually about 0.0018 inches, but in any event less than 0.003 inches. This dimension is defined as the vertical distance between the valve seat or land 158 and the opposed, largely flat, valve surface 156. Experimention has shown that the gap should not be simply increased beyond 0.003 inches to obtain higher flow rates since such increases will lead to lower homogenization efficiencies.

In the preferred embodiment, the valve seat is a knife-edge configuration. On the upstream, high pressure side of the gap, the valve seat 158 is chamfered at 45° angle sloping toward the valve surface 156. In the gap, the valve seat 158 is flat across a distance of ideally approximately 0.015 to 0.020 inches, but less than 0.06 inches. On the downstream, low pressure side of the gap 102, the valve seat slopes away from the valve surface at an angle from 5 to 90° or greater, 45° in the illustrated embodiment.

In the prior art valve gap region 160, fluid passing through the valve gap 102 is accelerated as it passes over the relatively short valve seat or land 158. The adjoining valve member presents a flat valve surface 156 that extends radially outward, parallel to the direction of fluid flow through the gap 102. The total length of the valve surface extending radially from the land is not a closely controlled tolerance but tends to be relatively long, approximately 0.055 inches in length.

Figure 4:
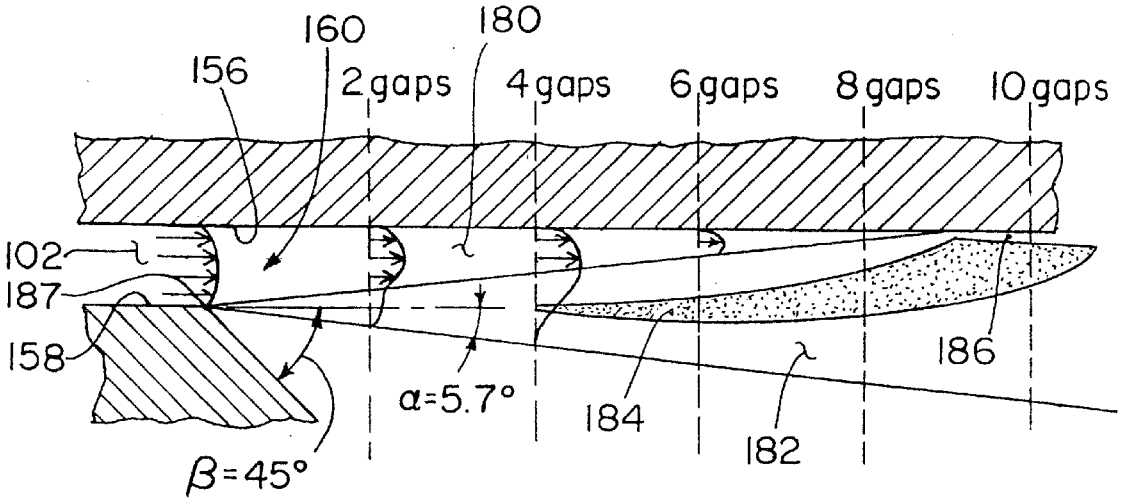
FIG. 4 PRIOR ART
FIG. 4 is a cross-sectional view of the prior art valve gap region and the flow conditions for the fluid emerging through the valve gap.

FIG. 4 illustrates the flow conditions for fluid passing through the prior art valve gap region 160. Just prior to the fluid's passage past the end 187 of the land 158, flow between the land 158 and the valve surface 156 is entirely laminar 180. Little homogenization occurs in this space, but the fluid is highly accelerated at this point. After passing through the valve gap, the portion of the fluid 180 in laminar flow reduces with increasing distance from the gap 102. The layers away from the valve surface 156 are progressively converted into turbulent three dimensional high and low speed mixing layers 182 in which the laminar characteristics do not exist. As a whole, the turbulent mixing layers are wedge shaped expanding downstream of the valve gap at an angle of approximately $\alpha$=5.7 degrees. At some point, the energy dissipation in the turbulent mixing layer peaks and a homogenization front or zone 184 forms in which the mixing layers merge and become fully turbulent. This is where most of the homogenization occurs. It is here that the energy contained in the fluid's pressure and speed is converted into the disruption of the milk fat globules or the blending of components in the emulsions or dispersions, generally.

The location of the homogenization front can be defined two ways. For a common valve gap for milk homogenization of 0.0018 inches, the homogenization front is centered at approximately 0.012 inches from the end 187 of the land surface. More generally, however, the homogenization front stretches across a distance of approximately 6 to 10 times the size of the gap. This relationship can be generalized to other valve configurations.

The problem with this prior art valve design is that there is incomplete convergence between the turbulent mixing layer 182 and the homogenization zone or front 184. The fluid passing through the valve gap 102 is, therefore, incompletely homogenized. Portions that pass through the turbulent mixing layer 182 but avoid the homogenization zone 184 experience incomplete homogenization.

Research has been performed in which photomicrographs were collected of dyed oil droplets passing through the valve using a frequency-doubled Nd:YAG laser. This work suggests that there is an additional mechanism that undermines complete homogenization. There appears to be a region of laminar flow 186 that extends beyond the homogenization front 184 that clings to the valve surface 156. This allows relatively large inhomogeneous species in the fluid to by-pass the homogenization zone 184. This effect explains the existence of large inhomogeneous structures within milk homogenized in these types of valves even when high homogenizing pressures are applied. This leads to a relatively large standard deviation in the size of the fat globules in the homogenized product.

Returning to FIG. 3, in the valve gap region 170 according to the present invention, the ends of the opposed surfaces that define the gap 102 are still staggered with respect to each other. The valve surface 156, however, terminates 188 much closer to the end of the land 158. There is some overlap, but the length of the overlap is closely controlled.

Figure 5:
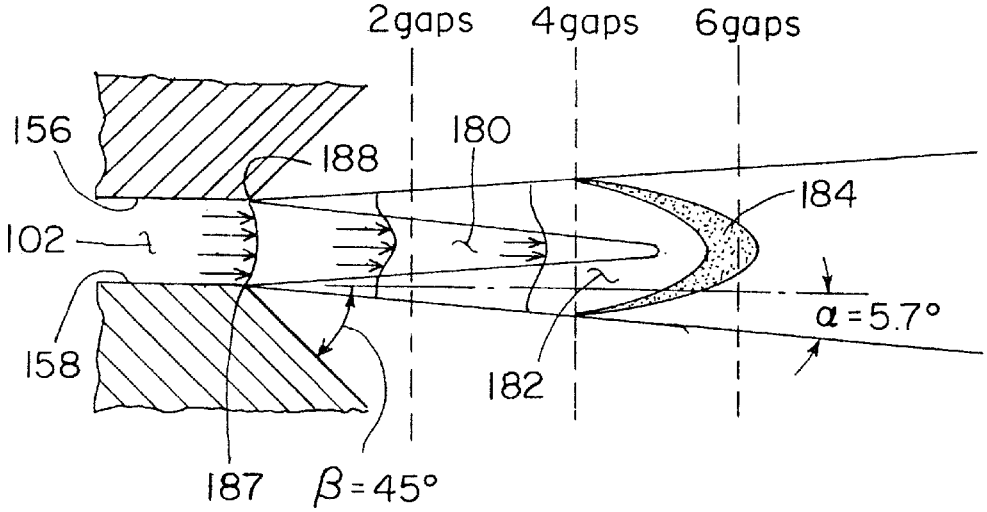
FIG. 5 is a cross-sectional view of the valve gap region in which no overlap exists between the upper and lower surfaces of the nozzle aperture according to the present invention.

FIG. 5 shows the flow conditions for the fluid emerging from valve gap 102 when no overlap exists. The region of laminar flow 180 exhibits a triangular cross-section extending away from the valve gap, decreasing on its top and bottom moving away from the ends of the valve surfaces. Most importantly, however, the homogenization zone or front 184 converges with the turbulent mixing layers 182. Virtually all fluid that exits from the valve passes through this zone existing at approximately 5 gap distances and is completely homogenized.

Figure 6:
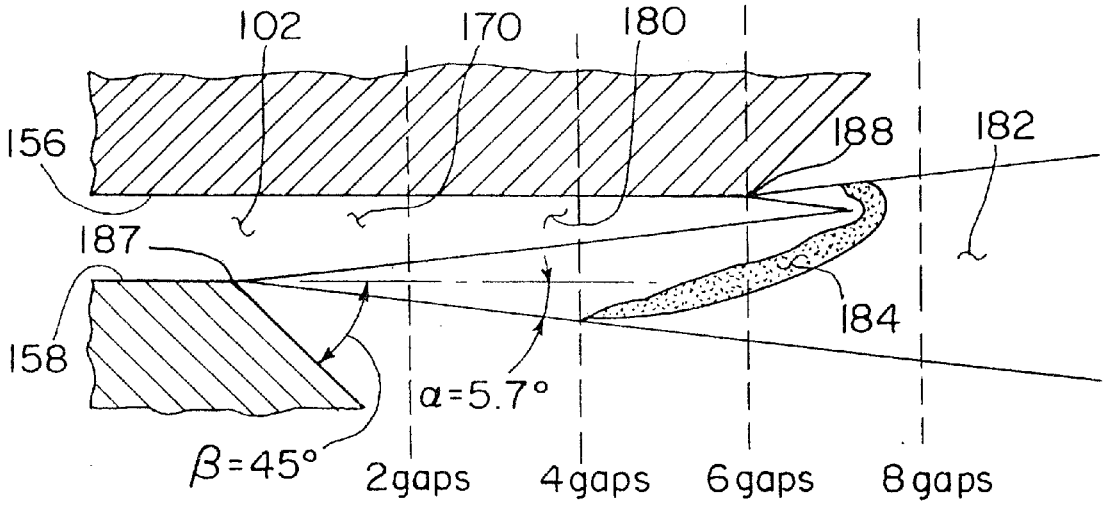
FIG. 6 is a cross-sectional view of the valve region showing a valve with only moderate overlap according to the present invention.

As shown in FIG. 6, even with some overlap (overlap=6 valve gaps), convergence of the turbulent mixing layer 182 and homogenization zone 184 can occur. The homogenization front is present at approximately 5 to 8 times the valve gap height from the end 187 of the land 156.

Moreover, the wall-effects from the valve surface 156 do not extend laminar flow 180 beyond the zone 184. Instead, the early truncation of surface 156 completely disturbs the laminar flow field 180, allowing the homogenization zone 184 to fully encompass the fluid exiting from the gap 102.

More generally, wall effects from the valve surface 156 and valve seat 158 will not otherwise arise as long as the chamfering angle $\beta$, which is illustrated as 45 degrees, does not approach the angle of divergence of the turbulent mixing layer, $\alpha$, which is 5.7 degrees. Usually, the angle $\beta$ is at least 10 degrees to avoid the risk of any attachment of the laminar flow to the wall.

Experiments suggest that this convergence can occur when the overlap is as long as ten valve gaps or approximately 0.02 inches when using conventional valve gap heights. An optimal overhang is approximately eight valve gaps or 0.016 inches of overlap or less.

Figure 7:
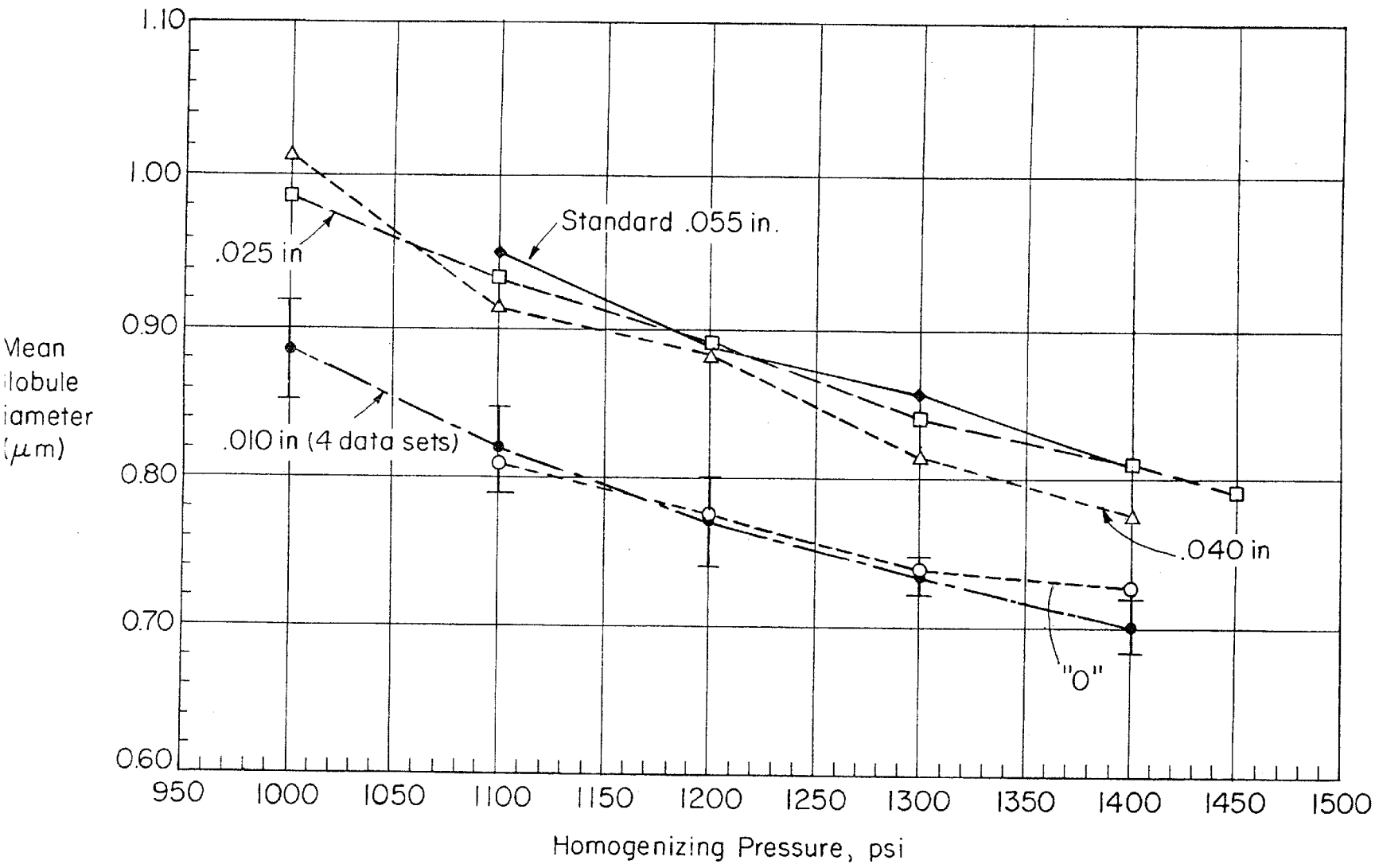
FIG. 7 is a plot of the droplet size as a function of homogenizing pressure for various valve overlap distances during commercial-scale milk homogenization.

FIG. 7 is a plot presenting the results of experiments correlating mean globule diameter in homogenized milk as a function of pressure for valves using different overlaps. Valve overlaps between 0.025 inches (□), 0.040 inches (Δ) and the standard 0.055 inches (●) exhibit essentially the same performance. A mean globule size of approximately 0.90 micrometers is produced between 1,100–1,200 psi homogenizing pressure. When overlaps of 0.010 (●) or 0.0 inches (no overlap) (☆) are used, however, the mean globule diameter drops to approximately 0.80 micrometers in the same range of homogenizing pressures. This experimentation shows that overlaps less than 10 valve gaps long, or approximately 0.025 inches, obtain substantially better homogenization.

The experimentation, however, indicates that in some circumstances there is a minimum desirable overlap. When the data points were collected for the zero overlap configuration in the generation of the plot in FIG. 7, the knife edge land was extensively damaged. This effect was evidenced by higher than normal noise levels from the valve stack. Observation of the knife edge after a ten thousand gallon run showed extensive chipping. This suggests that there were instabilities in operation associated with zero overlap. This instability is expected when there is no overlap or the overlap is less than one valve gap height. In the design of FIG. 1, this translates to an overlap of less than about 0.0015–0.0020 inches.

Figure 8:
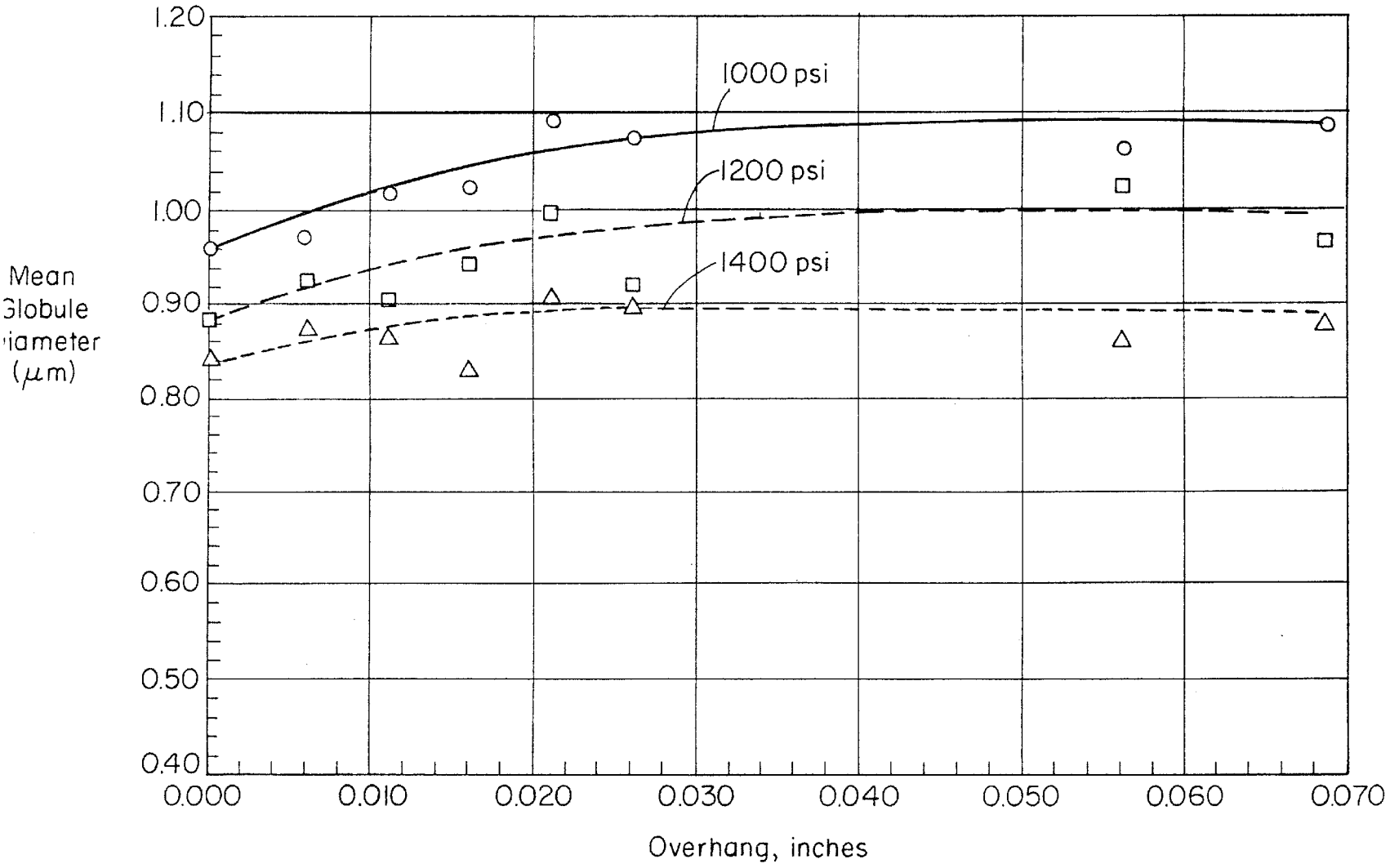
FIG. 8 is a plot of droplet diameter as a function of overlap for various homogenizing pressures using filled milk at a flow rate of 40 gallons per hour.

FIG. 8 shows the results of experimentation using a laboratory setup with a corresponding low flow rate. The plot is of droplet diameter as a function of overlap or overhang for three homogenizing pressures (1000 psi (○), 1200 psi (□), and 1400 psi (Δ)) using filled milk at a flow rate of 40 gallons per hour. Even at this low flow rate, a reduction in overlap yields better homogenization, agreeing with the experiments under commercial conditions.

While this invention has been particularly shown and described with references to preferred embodiments thereof, it will be understood by those skilled in the art that various changes in form and detail may be made therein without departing from the spirit and scope of the invention as defined by the appended claims.

What is claimed is:

1. A homogenizer valve comprising:

a stack of annularly-shaped valve members defining a central hole and axial fluid conduits with homogenization occurring as the fluid passes between the central hole and the axial fluid conduits through intervening annular valve gaps defined by opposed valve surfaces and valve seats, the gaps being less than 0.003 inches, in which the downstream terminations of the valve surfaces have an overlap that is less than 0.025 inches; and annular springs that align adjoining pairs of the valve members, the springs fitting in spring-grooves formed in the valve members.

2. The homogenizer valve described in claim 1, wherein downstream terminations of the valve surfaces overlap the valve seats by at least a height of the valve gaps.

3. The homogenizer valve described in claim 1, wherein the valve seat is chamfered in the downstream direction.

4. The homogenizer valve described in claim 3, wherein an angle of the chamfer is at least 10 degrees.

5. The homogenizer valve described in claim 3, wherein an angle of the chamfer is up to 90 degrees.

6. The homogenizer valve described in claim 1, wherein the valve seats are knife edge lands.

7. The homogenizer valve described in claim 6, wherein the valve seats are less than 0.06 inches in length.

* * * * *